US012385484B2

(12) United States Patent
Kuwahara et al.

(10) Patent No.: US 12,385,484 B2
(45) Date of Patent: Aug. 12, 2025

(54) COMPRESSOR

(71) Applicant: MITSUBISHI HEAVY INDUSTRIES THERMAL SYSTEMS, LTD., Tokyo (JP)

(72) Inventors: Takayuki Kuwahara, Tokyo (JP); Akinori Yoshioka, Tokyo (JP); Goshi Iketaka, Tokyo (JP); Makoto Takeuchi, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 18/272,454

(22) PCT Filed: Jan. 17, 2022

(86) PCT No.: PCT/JP2022/001384
§ 371 (c)(1),
(2) Date: Jul. 14, 2023

(87) PCT Pub. No.: WO2022/158419
PCT Pub. Date: Jul. 28, 2022

(65) Prior Publication Data

US 2024/0068472 A1 Feb. 29, 2024

(30) Foreign Application Priority Data

Jan. 22, 2021 (JP) ..... 2021-008859

(51) Int. Cl.
*F04C 18/02* (2006.01)
*F01C 17/06* (2006.01)
(Continued)

(52) U.S. Cl.
CPC ..... *F04C 18/0215* (2013.01); *F01C 17/063* (2013.01); *F04C 18/02* (2013.01);
(Continued)

(58) Field of Classification Search
CPC ..... F04C 18/0215; F04C 23/008; F04C 29/0057; F01C 17/063; F01C 17/066
See application file for complete search history.

(56) References Cited

U.S. PATENT DOCUMENTS

2014/0369819 A1* 12/2014 Yamashita ..... F01C 17/063 418/55.3
2017/0184107 A1* 6/2017 Gossen ..... F04C 18/0253
(Continued)

FOREIGN PATENT DOCUMENTS

EP 1 950 419 A1 7/2008
JP 2001-132670 A 5/2001
(Continued)

OTHER PUBLICATIONS

JP2008208718A—Suzuki et al.—Scroll Compressor—Sep. 11, 2008—English Machine Translation (Year: 2008).*
(Continued)

*Primary Examiner* — Theresa Trieu
(74) *Attorney, Agent, or Firm* — BIRCH, STEWART, KOLASCH & BIRCH, LLP

(57) ABSTRACT

Provided is an electric compressor comprising: a housing; a fixed scroll that is housed in the housing and fixed on the housing side; a turning scroll that meshes with the fixed scroll and turns with respect to the fixed scroll; an autorotation inhibiting mechanism that inhibits autorotation of the turning scroll; and a lubricant supply unit that supplies a lubricant to the autorotation inhibiting mechanism. The autorotation inhibiting mechanism has: a ring hole which is formed in the turning scroll; a ring which is disposed in the ring hole, and the outer circumferential surface of which faces the inner circumferential surface of the ring hole; and a pin which is provided to the housing and which engages with the inner circumferential surface of the ring. A gap
(Continued)

formed between the inner circumferential surface of the ring hole and the outer circumferential surface of the ring is 0.1-0.6 mm.

8 Claims, 4 Drawing Sheets

(51) Int. Cl.
*F04C 23/00* (2006.01)
*F04C 29/00* (2006.01)
*F04C 29/02* (2006.01)

(52) U.S. Cl.
CPC ..... *F04C 29/0057* (2013.01); *F04C 29/02* (2013.01); *F04C 23/008* (2013.01)

(56) References Cited

U.S. PATENT DOCUMENTS

| | | | | |
|---|---|---|---|---|
| 2018/0163724 | A1 | 6/2018 | Lim et al. | |
| 2020/0080547 | A1* | 3/2020 | Cho | F04C 18/0215 |

FOREIGN PATENT DOCUMENTS

| | | | | | |
|---|---|---|---|---|---|
| JP | 2008-180094 | A | | 8/2008 | |
| JP | 2008208715 | A | * | 9/2008 | F01C 17/063 |
| JP | 4427354 | B2 | | 3/2010 | |
| JP | 2017-532495 | A | | 11/2017 | |
| WO | WO 2016/067206 | A1 | | 5/2016 | |
| WO | WO 2016/143952 | A1 | | 9/2016 | |

OTHER PUBLICATIONS

DE102018107460A1—Yamashita et al.—Compressor of the Screw Type—Oct. 4, 2018—English Machine Translation—(Year: 2018).*
International Search Report for International Application No. PCT/JP2022/001384, dated Feb. 15, 2022, with English translation.
Written Opinion of the International Searching Authority for International Application No. PCT/JP2022/001384, dated Feb. 15, 2022, with English translation.
Extended European Search Report for European Application No. 22742541.0, dated May 13, 2024.

* cited by examiner

COMPRESSOR

TECHNICAL FIELD

The present disclosure relates to a compressor.

BACKGROUND ART

There is a scroll compressor including a pair of a fixed scroll and an orbiting scroll that mesh with each other to form a compression chamber. The orbiting scroll compresses a refrigerant gas in the compression chamber through revolving and orbiting with respect to the fixed scroll.

The scroll compressor is provided with a rotation prevention mechanism in order to prevent the rotation of the orbiting scroll. Examples of the rotation prevention mechanism include an Oldham link-type rotation prevention mechanism and a pin ring-type rotation prevention mechanism. For example, PTL 1 discloses a scroll compressor including a pin ring type rotation prevention mechanism.

PTL 1 discloses a scroll-type compressor in which a pin-and-ring coupling is disposed between a movable spiral body and an end surface of a front housing. The pin-and-ring coupling has a movable-side pin fixed to the movable spiral body, a fixed-side pin fixed to the front housing, and a ring into which the movable-side pin and the fixed-side pin are inserted. The ring is accommodated in a recessed portion formed in the housing, and moves with the revolving motion of the movable spiral body while being in sliding contact with a bottom surface of the recessed portion.

CITATION LIST

Patent Literature

[PTL 1] Japanese Unexamined Patent Application Publication No. 2001-132670

SUMMARY OF INVENTION

Technical Problem

In a rotation prevention mechanism having a ring accommodated in a recessed portion and a pin that engages with the ring, in the related art, a gap formed between an inner peripheral surface of the recessed portion and an outer peripheral surface of the ring is reduced. This is because the Hertz stress is reduced by reducing the gap, and damage to the recessed portion is suppressed. On the other hand, as long as there is a gap between the inner peripheral surface of the recessed portion and the outer peripheral surface of the ring, the inner peripheral surface of the recessed portion and the outer peripheral surface of the ring collide with each other due to the load generated by orbiting of the orbiting scroll. There has been a problem of noise generated when the ring collides with the recessed portion.

The present disclosure has been made in view of such circumstances, and an object of the present disclosure is to provide a compressor capable of suppressing noise caused by contact between a recessed portion and a ring.

Solution to Problem

In order to solve the above problems, the compressor of the present disclosure adopts the following means.

According to one aspect of the present disclosure, there is provided a compressor including a casing that forms an outer shell; a fixed scroll that is accommodated in the casing and fixed to the casing side; an orbiting scroll that is meshed with the fixed scroll and orbits with respect to the fixed scroll; a rotation prevention mechanism that prevents rotation of the orbiting scroll; and a lubricant supply unit that supplies a lubricant to the rotation prevention mechanism, in which the rotation prevention mechanism includes a recessed portion formed on either the orbiting scroll side or the casing side, a ring disposed in the recessed portion and having an outer peripheral surface facing an inner peripheral surface of the recessed portion, and a pin provided on either the orbiting scroll side or the casing side and engaged with an inner peripheral surface of the ring, and a gap formed between the inner peripheral surface of the recessed portion and the outer peripheral surface of the ring is 0.1 mm or more and 0.6 mm or less.

Advantageous Effects of Invention

According to the present disclosure, noise caused by contact between the recessed portion and the ring can be suppressed.

DESCRIPTION OF EMBODIMENTS

Hereinafter, an embodiment of a compressor according to the present disclosure will be described with reference to the drawings.

First Embodiment

Hereinafter, a first embodiment of the present disclosure will be described with reference to FIGS. 1 to 4.

Figure 1:
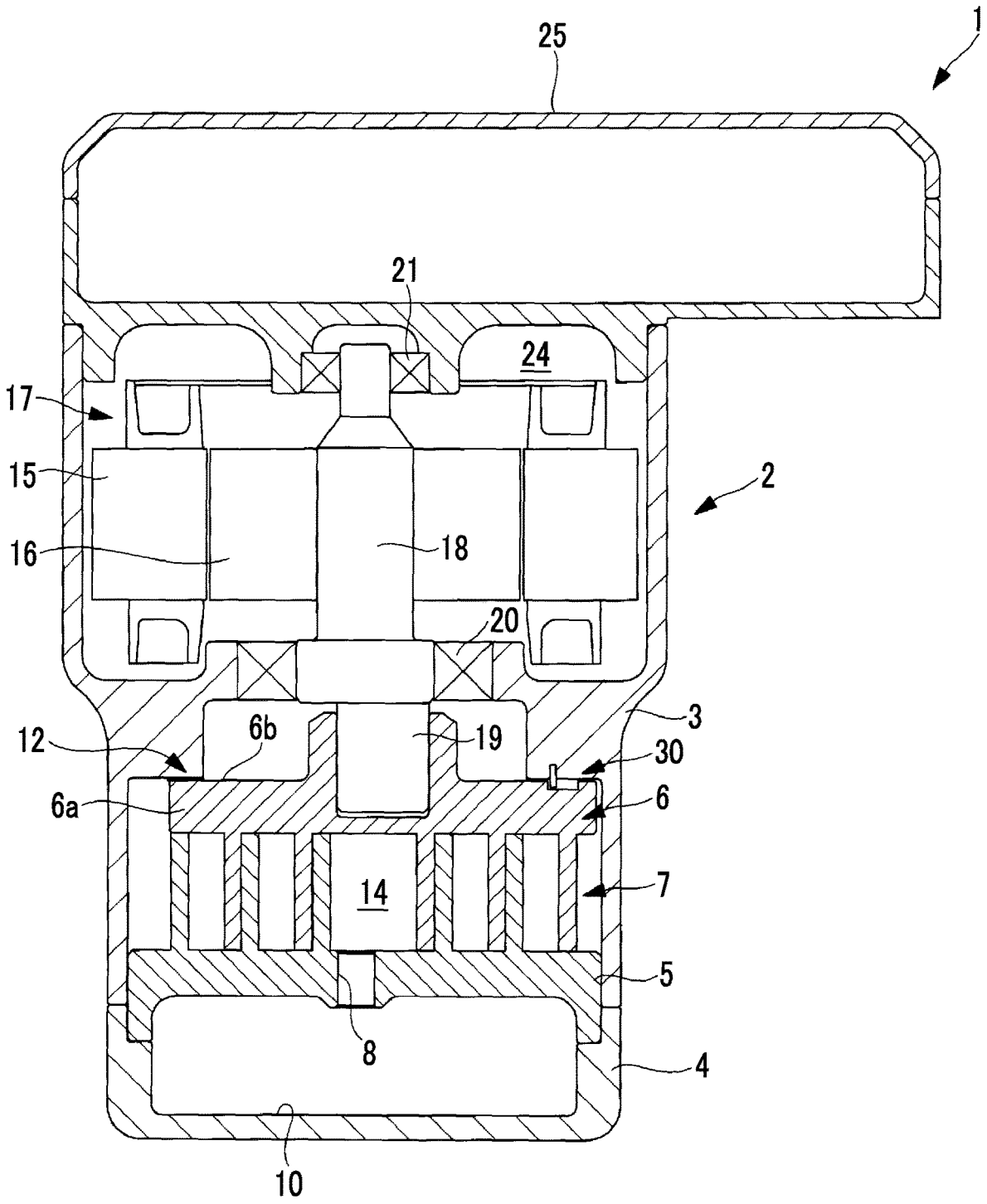
FIG. 1 is a vertical sectional view of an electric compressor according to an embodiment of the present disclosure.

FIG. 1 is a vertical sectional view of an electric compressor 1 according to the present embodiment.

The electric compressor 1 according to the present embodiment is an inverter-integrated electric compressor in which an inverter (not shown) for driving a motor 17 is integrally incorporated.

The electric compressor 1 includes a housing (casing) 2 that forms an outer shell, a scroll compression mechanism 7 accommodated in the housing 2, and the motor 17 that drives the scroll compression mechanism 7.

The housing 2 has a cylindrical first housing 3 extending along a central axis, and a second housing 4 that closes one end side (lower end side in FIG. 1) of the first housing 3 in a direction of the central axis.

The scroll compression mechanism 7 is incorporated in one end side of the housing 2. The scroll compression mechanism 7 has a pair of fixed scroll 5 and an orbiting scroll 6. The scroll compression mechanism 7 compresses a refrigerant gas. The high-pressure refrigerant gas compressed by the scroll compression mechanism 7 is discharged into a discharge chamber 10 through a discharge port 8. The discharge port 8 is formed at the center of the fixed scroll 5. The refrigerant gas discharged into the discharge chamber 10 is discharged to the outside of the electric compressor 1 via a discharge port (not shown) provided in the housing 2.

The fixed scroll 5 is fixed to the second housing 4 by a fastener (not shown) such as a bolt. The orbiting scroll 6 is supported by a thrust bearing 12 to be able to orbit via a rotation prevention mechanism 30. The details of the rotation prevention mechanism 30 will be described later. The orbiting scroll 6 orbits with respect to the fixed scroll 5. The fixed scroll 5 and the orbiting scroll 6 are made of, for example, aluminum. Raw materials of the fixed scroll 5 and the orbiting scroll 6 are not limited to aluminum.

The fixed scroll 5 and the orbiting scroll 6 are engaged with each other to be meshed with each other. A compression chamber 14 is formed between the fixed scroll 5 and the orbiting scroll 6. In the scroll compression mechanism 7, the orbiting scroll 6 orbits (revolves) such that a volume of the compression chamber 14 decreases from the outer peripheral side toward the center side, and thus the refrigerant in the compression chamber 14 is compressed.

The motor 17 is incorporated in the other end side of the cylindrical housing 2. The motor 17 has a stator 15 and a rotor 16. A drive shaft 18 is joined to the rotor 16. The drive shaft 18 is rotatably supported by a bearing 20 installed near a central portion inside the housing 2 and a bearing 21 installed near the other end portion inside the housing 2. A crank pin 19 is provided at one end of the drive shaft 18. The central axes of the drive shaft 18 and the crank pin 19 are eccentric. The crank pin 19 is connected to the orbiting scroll 6. That is, the drive shaft 18 connects the motor 17 to the scroll compression mechanism 7. The motor 17 causes the orbiting scroll 6 to orbit via the drive shaft 18.

A driven crank mechanism (not shown) is provided between the crank pin 19 and the orbiting scroll 6. The driven crank mechanism performs the orbiting radius of the orbiting scroll 6 variable. Examples of the driven crank mechanism include a swing link type driven crank mechanism.

A suction port (not shown) for sucking a low-pressure refrigerant gas from a refrigerating cycle is provided on the other end side of the housing 2. The refrigerant gas sucked from the suction port flows into a space 24 between the first housing 3 and one end of the motor 17. The low-pressure refrigerant gas that has flowed into the space 24 fills the inside of the housing 2. Specifically, the low-pressure refrigerant gas that has flowed into the space 24 flows to the scroll compression mechanism 7 side, is sucked into the scroll compression mechanism 7, and is compressed. A lubricant is contained in the refrigerant gas. The lubricant contained in the refrigerant gas is supplied to the scroll compression mechanism 7 and the rotation prevention mechanism 30 together with the refrigerant gas to lubricate each mechanism. That is, the suction port has a function as a lubricant supply unit that supplies a lubricant to the rotation prevention mechanism 30.

An inverter accommodating portion 25 is provided on the other end side (upper end side in FIG. 1) in a direction along the central axis of the housing 2. The other end side of the first housing 3 is closed by the inverter accommodating portion 25. An inverter (not shown) that drives the motor 17 is accommodated inside the inverter accommodating portion 25. The inverter drives the motor 17 by converting DC power supplied from an external battery or the like into three-phase AC power having a required frequency and applying the AC power to the motor 17 via terminals (not shown).

Next, the rotation prevention mechanism 30 will be described in detail.

The rotation prevention mechanism 30 according to the present embodiment is a so-called pin ring type rotation prevention mechanism. The rotation prevention mechanism 30 prevents the rotation of the orbiting scroll 6. The rotation prevention mechanism 30 has a plurality of pin ring structures (rotation prevention structures) 31 (six in the present embodiment as an example) (refer to FIG. 3). The plurality of pin ring structures 31 are provided at equal intervals in the circumferential direction around the central axis of the drive shaft 18 or the orbiting scroll 6. That is, in the present embodiment, since the six pin ring structures 31 are provided, the six pin ring structures 31 are provided at intervals of 60 degrees in the circumferential direction.

Since each of the plurality of pin ring structures 31 has the same structure, in principle, one pin ring structure 31 will be described as a representative below.

Figure 2:
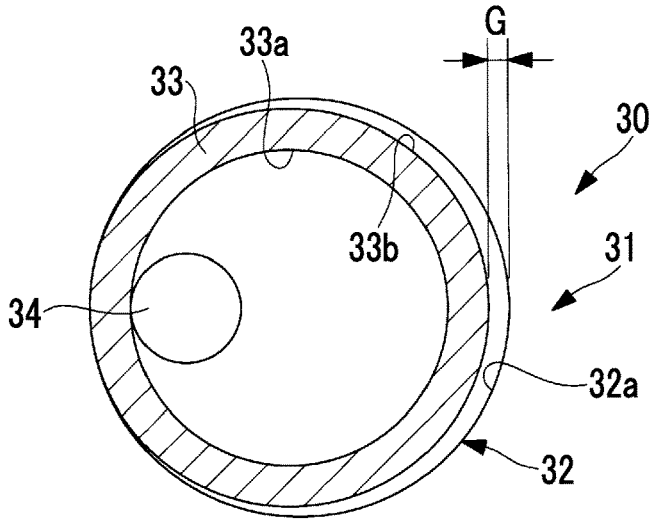
FIG. 2 is a plan view of a pin ring structure according to the embodiment of the present disclosure.

As shown in FIGS. 1 and 2, the pin ring structure 31 includes a ring hole (recessed portion) 32 formed in the orbiting scroll 6, a ring 33 accommodated in the ring hole 32, and a pin 34 that engages with an inner peripheral surface 33*a* of the ring 33.

Figure 3:
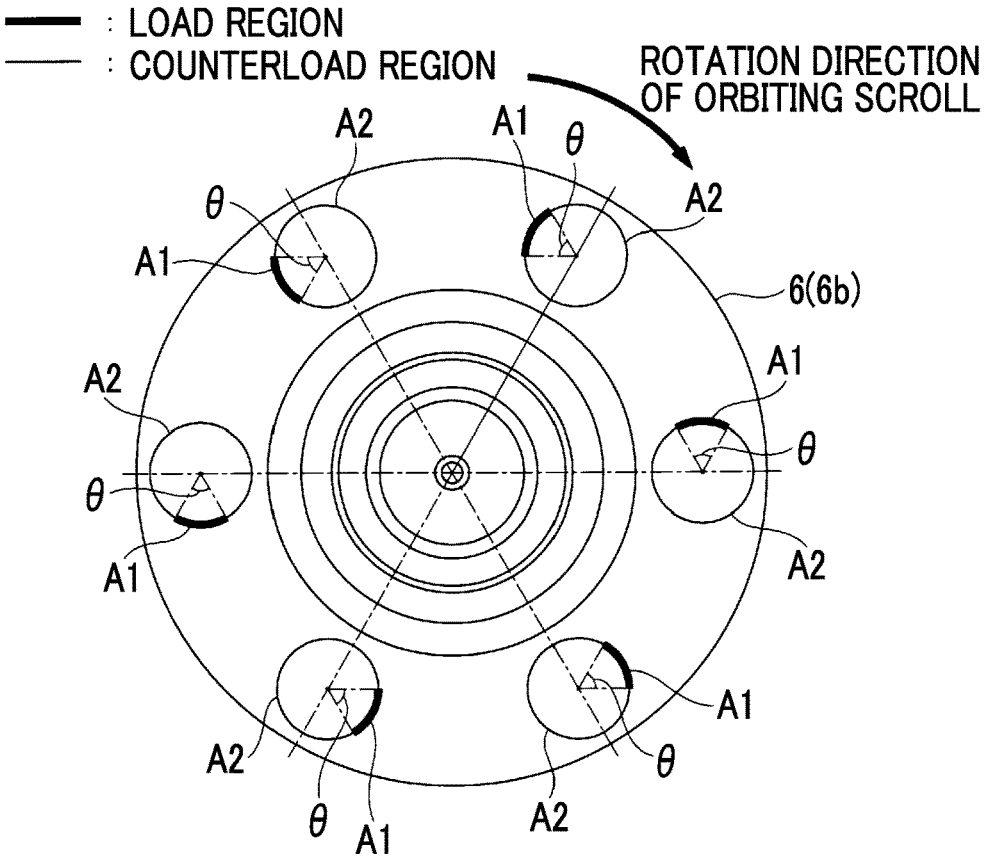
FIG. 3 is a schematic diagram showing a region in which a load acts on each ring hole according to the embodiment of the present disclosure.

As shown in FIG. 3, the plurality of ring holes 32 are disposed to be arranged at predetermined intervals in an end plate 6*a* of the orbiting scroll 6. Specifically, the plurality of ring holes 32 are disposed to be arranged in the circumferential direction with the center point of the orbiting scroll 6 as the center. The ring hole 32 is formed on a surface (hereinafter, referred to as a "back surface 6*b*") of the end plate 6*a* of the orbiting scroll 6 opposite to the surface forming the compression chamber 14. The ring hole 32 is recessed to a predetermined depth from the back surface 6*b* of the orbiting scroll 6. The ring hole 32 is a bottomed recessed portion. The ring hole 32 has a perfect circular shape in a plan view. That is, an inner peripheral surface 32*a* of the ring hole 32 is a cylindrical surface.

The ring 33 is a cylindrical member having a predetermined thickness. A length of the ring 33 in the direction of the central axis is substantially the same as the depth of the ring hole 32. The ring 33 is disposed in the ring hole 32. The ring 33 is disposed such that an outer peripheral surface 33*b* faces the inner peripheral surface 32*a* of the ring hole 32. The ring 33 is made of, for example, high carbon chrome bearing steel (SUJ2). A raw material of the ring 33 is not limited to the high carbon chrome bearing steel (SUJ2). In the present embodiment, an outer diameter of the ring 33 is 13 mm or more and 15.5 mm or less. The value of the outer diameter of the ring 33 is an example and is not limited to this value.

A gap G is formed between the inner peripheral surface 32*a* of the ring hole 32 and the outer peripheral surface 33*b* of the ring 33. Regarding a length of the gap G, a length of the longest portion in a state in which a part of the outer peripheral surface 33*b* of the ring 33 is in contact with the inner peripheral surface 32*a* of the ring hole 32 (hereinafter, simply a "length of the gap G") is 0.1 mm or more and 0.6 mm or less. That is, the outer diameter of the ring 33 is smaller than the diameter of the ring hole 32. Specifically, the outer diameter of the ring 33 is smaller than the diameter of the ring hole 32 by the length of the gap G.

A plurality of pins 34 are disposed to correspond to the rings 33 disposed in the respective ring holes 32. Specifically, the plurality of pins 34 are disposed to be arranged at equal intervals in the circumferential direction with the central axis of the drive shaft 18 as the center. As shown in FIG. 1, the pin 34 is fixed to the first housing 3. As shown in FIG. 2, the pin 34 is engaged with the inner peripheral surface 33*a* of the ring 33. A tip of the pin 34 is separated from the bottom surface of the ring hole 32.

The plurality of pin ring structures 31 are disposed to sequentially receive a load in accordance with the orbiting motion of the orbiting scroll 6. That is, the rotation prevention mechanism 30 sequentially passes the rotation prevention function between the plurality of pin ring structures 31 in accordance with the orbiting motion of the orbiting scroll 6 (in other words, the pin ring structures 31 that function as the rotation prevention mechanism 30 are switched), and thus the rotation of the orbiting scroll 6 is prevented.

The inner peripheral surface 32*a* of the ring hole 32 of each pin ring structure 31 has a load region A1 over a predetermined angle range in which a load is received from the pin 34 in accordance with the orbiting motion of the orbiting scroll 6. Specifically, the load region A1 of the ring hole 32 receives the load from the pin 34 via the ring 33. As shown in FIG. 3, the load region A1 in each of the ring holes 32 is provided to be displaced by 60 degrees when the back surface 6*b* of the end plate 6*a* of the orbiting scroll 6 is viewed in a plan view. The load region A1 of each ring hole 32 is provided to form an arc at an angle θ (60 degrees in the present embodiment) when the back surface 6*b* of the end plate 6*a* of the orbiting scroll 6 is viewed in a plan view.

Next, a behavior of the rotation prevention mechanism 30 will be described.

In the rotation prevention mechanism 30, the pin 34 and the ring 33 move relative to each other as the orbiting scroll 6 orbits, so that the pin 34 and the ring 33 come into contact with each other, and the rotation of the orbiting scroll 6 is prevented due to the contact. In the present embodiment, the pin 34 fixed to the housing 2 does not move, but the ring 33 provided in the orbiting scroll 6 moves.

Next, a behavior of each pin ring structure 31 will be described. When the orbiting scroll 6 orbits, first, one pin ring structure 31 among the six pin ring structures 31 performs the rotation prevention function. Specifically, as the ring 33 moves relative to the pin 34, the inner peripheral surface 33*a* of the ring 33 provided in one pin ring structure 31 receives a load from the pin 34. As described above, the movement of the ring hole 32 and the ring 33 is restricted by the pin 34, and thus the rotation of the orbiting scroll 6 is prevented. The ring 33 moves along the outer peripheral surface of the pin 34 by a predetermined angle range (60 degrees in the present embodiment) while receiving a load. As a result, the load region A1 of the ring hole 32 also receives the load via the ring 33. When the ring 33 and the ring hole 32 move by a predetermined angle range, the rotation prevention mechanism 30 switches the pin ring structures 31 that perform the rotation prevention function. Specifically, switching to the pin ring structure 31 located on the front side of the orbiting scroll 6 in the orbiting direction occurs. Also in this pin ring structure 31, the rotation of the orbiting scroll 6 is prevented in the same manner. As described above the rotation prevention mechanism 30 prevents the rotation of the orbiting scroll 6 by repeatedly passing the rotation prevention function between the plurality of pin ring structures 31.

According to the present embodiment, the following actions and effects are achieved.

In the present embodiment, the length of the gap G formed between the ring hole 32 and the ring 33 is 0.1 mm or more and 0.6 mm or less. As a result, the lubricant supplied to the rotation prevention mechanism 30 easily flows into the gap G. The lubricant that has flowed into the gap G alleviates an impact when the ring hole 32 and the ring 33 come into contact with each other. Therefore, noise caused by contact between the ring hole 32 and the ring 33 can be suppressed.

The noise caused by the contact between the ring hole 32 and the ring 33 includes, for example, noise generated when the pins 34 and the rings 33 having the rotation prevention function are switched.

Figure 4:
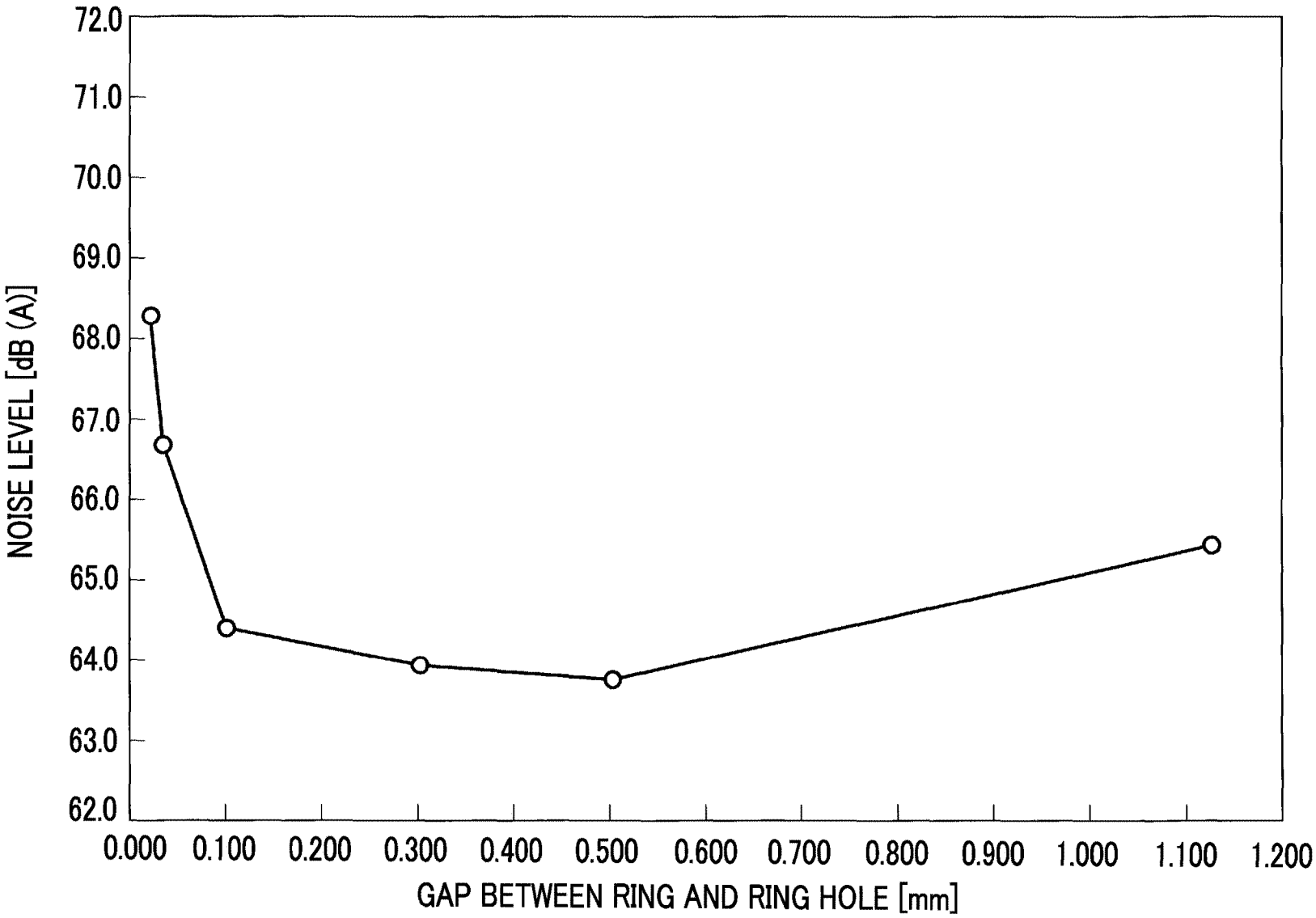
FIG. 4 is a graph showing a relationship between a size of a gap between a ring and a ring hole and a noise level.

Next, a noise reduction effect of the rotation prevention mechanism 30 according to the present embodiment will be described with reference to a graph of FIG. 4. FIG. 4 shows experimental results of investigating a relationship between the length of the gap G and the noise level. In FIG. 4, a horizontal axis represents the length of the gap G, and a vertical axis represents the noise level.

As shown in FIG. 4, in a case where the length of the gap G is less than 0.1 mm, the noise level is relatively high. It is considered that this is because, in a case where the length of the gap G is less than 0.1 mm, it is difficult for the lubricant to flow into the gap G. When the length of the gap G is 0.1 mm, the noise level is sharply reduced compared with the case where the gap G is less than 0.1 mm. This is because the length of the gap G is 0.1 mm, so that the lubricant suitably flows into the gap G.

It can be seen that, in a range in which the length of the gap G is 0.1 mm or more and less than 0.5 mm, the noise level decreases as the length of the gap G increases. When the length of the gap G is 0.5 mm or more, the noise level gradually increases. However, it can be seen that the noise level is sufficiently low when the length of the gap G is 0.6 mm or less.

As described above, it can be understood from FIG. 4 that noise can be suppressed in a case where the length of the gap G is 0.1 mm or more and 0.6 mm or less.

The graph in FIG. 4 is suitably appropriate in a case where the outer diameter of the ring 33 is 13 mm or more and 15.5 mm or less.

Second Embodiment

Next, a second embodiment of the present disclosure will be described with reference to FIG. 5.

The present embodiment is different from the first embodiment in that a storage portion is formed in the ring hole 32. The present embodiment is the same as the first embodiment except that the storage portion is formed. Therefore, the same reference numerals are given to the same configurations, and detailed description thereof will be omitted.

Figure 5:
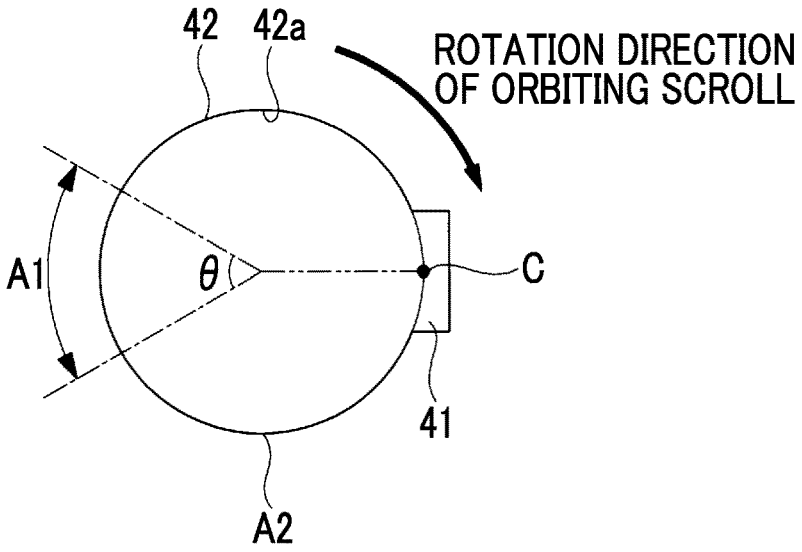
FIG. 5 is a schematic plan view showing a ring hole according to a second embodiment of the present disclosure.

As shown in FIG. 5, a storage portion 41 recessed outward in a radial direction is formed on an inner peripheral surface 42*a* of a ring hole 42 according to the present embodiment. The storage portion 41 is formed in a rectangular shape in a plan view. The storage portion 41 is formed in a region other than the load region A1 (hereinafter, referred to as a "counterload region A2"). In the present embodiment, the storage portion 41 is disposed to include a midpoint C in the circumferential direction of the counterload region A2. That is, the storage portion 41 is provided at a position farthest from the load region A1.

The storage portion 41 may be formed in all the ring holes 32 or may be formed in only some of the ring holes 32.

According to the present embodiment, the following actions and effects are achieved.

In the present embodiment, the lubricant supplied to the rotation prevention mechanism 30 is stored in the storage portion 41. Since the storage portion 41 is formed on the inner peripheral surface 42*a* of the ring hole 42, in a case where an amount of lubricant held in the gap G between the inner peripheral surface 42*a* of the ring hole 42 and the outer peripheral surface 33*b* of the ring 33 is reduced, the lubricant stored in the storage portion 41 is guided to the gap G. Therefore, the lubricant is more preferably held in the gap G. Therefore, noise caused by contact between the ring hole 42 and the ring 33 can be further suppressed.

In a case where the storage portion is formed in the load region A1, the ring 33 may be deformed to be pushed into the storage portion 41 due to the load from the pin 34 due to the orbiting motion of the orbiting scroll 6. The storage portion 41 may also be damaged by the load from the pin 34. On the other hand, in the present embodiment, the storage portion 41 is formed in the counterload region A2. As a result, deformation of and damage to the ring 33 can be suppressed. Damage to the storage portion 41 due to the load from the pin 34 can be suppressed.

Modification Example

Figure 6:
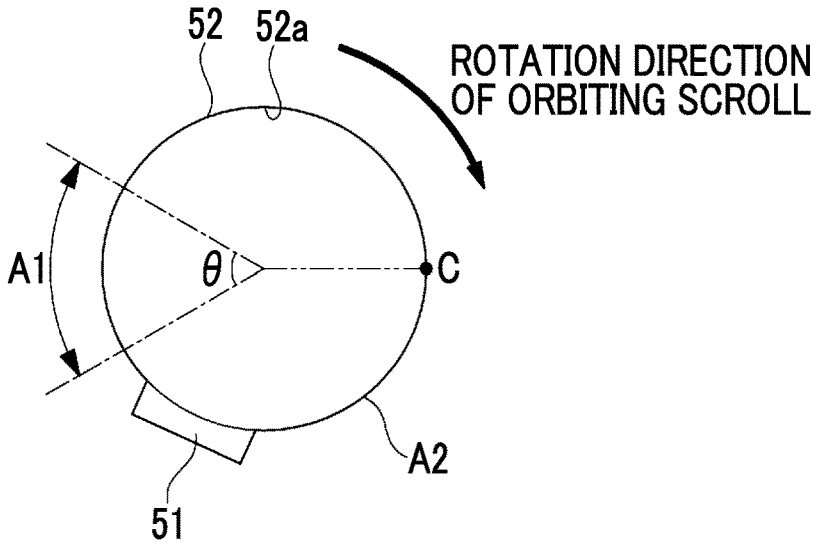
FIG. 6 is a diagram illustrating a modification example corresponding to FIG. 5.

As in a ring hole 52 shown in FIG. 6, on an inner peripheral surface 52*a* of the ring hole 52, the entire storage portion 51 may be provided in front of the midpoint C in the circumferential direction of the counterload region A2 in the orbiting direction of the orbiting scroll 6.

The lubricant stored in the storage portion is guided to the load region A1 due to orbiting of the orbiting scroll 6. Therefore, in the present modification example, a distance through which the lubricant travels is shorter than in a case where the storage portion is provided behind the midpoint C in the orbiting direction. Therefore, the lubricant can be suitably guided to the load region A1. Therefore, in the load region A1, the impact when the ring hole 52 and the ring 33 come into contact with each other can be suitably alleviated. Therefore, noise caused by contact between the ring hole 52 and the ring 33 can be more suitably suppressed.

The present disclosure is not limited to the invention according to each of the above embodiments, and can be modified as appropriate without departing from the concept thereof.

For example, in each of the above embodiments, an example in which the electric compressor 1 is an inverter-integrated electric compressor has been described, but the present disclosure is not limited thereto. For example, the electric compressor 1 may be an electric compressor that does not include an inverter. The electric compressor 1 may be an electric compressor in which an inverter is separately provided.

Shapes of the storage portions 41 and 51 are not limited to the shapes described above. For example, in a plan view, the shape may be an oval shape or an elliptical shape.

In each of the above embodiments, an example in which the ring hole 32 is formed in the orbiting scroll 6 and the pin 34 is fixed to the first housing 3 has been described, but the present disclosure is not limited thereto. For example, the ring hole 32 may be formed in the first housing 3, and the pin 34 may be fixed to the orbiting scroll 6.

The compressor described in the embodiment described above is understood as follows, for example.

A compressor according to one aspect of the present disclosure includes a casing (2) that forms an outer shell, a fixed scroll (5) that is accommodated in the casing and fixed to the casing side, an orbiting scroll (6) that is meshed with the fixed scroll and orbits with respect to the fixed scroll, a rotation prevention mechanism (30) that prevents rotation of the orbiting scroll, and a lubricant supply unit that supplies a lubricant to the rotation prevention mechanism, in which the rotation prevention mechanism includes a recessed portion (32) formed on either the orbiting scroll side or the casing side, a ring (33) disposed in the recessed portion and having an outer peripheral surface (33*b*) facing an inner peripheral surface (32*a*) of the recessed portion, and a pin (34) provided on either the orbiting scroll side or the casing side and engaged with an inner peripheral surface (33*a*) of the ring, and a gap formed between the inner peripheral surface of the recessed portion and the outer peripheral surface of the ring is 0.1 mm or more and 0.6 mm or less.

In the above configuration, the gap formed between the recessed portion and the ring is 0.1 mm or more and 0.6 mm or less. As a result, the lubricant supplied from the lubricant supply unit to the rotation prevention mechanism easily flows into the gap formed between the recessed portion and the ring. The lubricant that has flowed into the gap alleviates an impact when the recessed portion and the ring come into contact with each other. Therefore, noise caused by contact between the recessed portion and the ring can be suppressed.

The noise caused by the contact between the recessed portion and the ring includes, for example, noise generated when, among a plurality of combinations of pins and rings, the rotation prevention function is passed from one combination of a pin and a ring to another combination of a pin and a ring (when the pins and the rings that perform the rotation prevention function are switched).

In the compressor according to one aspect of the present disclosure, the outer diameter of the ring is 13 mm or more and 15.5 mm or less.

In the compressor according to one aspect of the present disclosure, the recessed portion is provided with the storage portion (41, 51) recessed outward in a radial direction on the inner peripheral surface that is a cylindrical surface.

In the above configuration, the lubricant supplied from the lubricant supply unit to the rotation prevention mechanism is stored in the oil storage portion. As a result, since the storage portion is formed on the inner peripheral surface of the recessed portion, in a case where an amount of lubricant held in the gap between the inner peripheral surface of the recessed portion and the outer peripheral surface of the ring is reduced, the lubricant stored in the storage portion is guided to the gap. Therefore, the lubricant is more preferably held in the gap between the inner peripheral surface of the recessed portion and the outer peripheral surface of the ring. Therefore, noise caused by contact between the recessed portion and the ring can be further suppressed.

A compressor according to one aspect of the present disclosure includes a casing (2) that forms an outer shell, a fixed scroll (5) that is accommodated in the casing and fixed to the casing side, an orbiting scroll (6) that is meshed with the fixed scroll and orbits with respect to the fixed scroll, a rotation prevention mechanism (30) that prevents rotation of the orbiting scroll, and a lubricant supply unit that supplies a lubricant to the rotation prevention mechanism, in which the rotation prevention mechanism includes a recessed portion (32) formed on either the orbiting scroll side or the casing side, a ring (33) disposed in the recessed portion and having an outer peripheral surface (33*b*) facing an inner peripheral surface (32*a*) of the recessed portion, and a pin (34) provided on either the orbiting scroll side or the casing side and engaged with an inner peripheral surface (33*a*) of the ring, and the recessed portion is provided with a storage portion (41, 51) recessed outward in a radial direction on the inner peripheral surface that is a cylindrical surface.

In the above configuration, the lubricant supplied from the lubricant supply unit to the rotation prevention mechanism is stored in the oil storage portion. As a result, since the storage portion is formed on the inner peripheral surface of the recessed portion, in a case where an amount of lubricant held in the gap between the inner peripheral surface of the recessed portion and the outer peripheral surface of the ring is reduced, the lubricant stored in the storage portion is guided to the gap. Therefore, the lubricant can be easily held in the gap between the inner peripheral surface of the recessed portion and the outer peripheral surface of the ring. The lubricant that has flowed into the gap alleviates an impact when the recessed portion and the ring come into contact with each other. Therefore, noise caused by contact between the recessed portion and the ring can be suppressed.

In the compressor according to one aspect of the present disclosure, the rotation prevention mechanism has a plurality of rotation prevention structures that are a combination of the recessed portion, the ring, and the pin, the plurality of rotation prevention structures are disposed to sequentially receive a load in accordance with orbiting motion of the orbiting scroll, the inner peripheral surface of the recessed portion of each rotation prevention structure has a load region (A1) over a predetermined angle range in which the load is received from the pin in accordance with the orbiting motion of the orbiting scroll, and the storage portion is provided in a region (A2) other than the load region on the inner peripheral surface of the recessed portion.

In a case where the storage portion is formed in the load region, the ring may be deformed to be pushed into the storage portion due to the load from the pin due to the orbiting motion of the orbiting scroll. The storage portion may be damaged by the load from the pin. On the other hand, in the above configuration, the storage portion is formed in a region other than the load region. As a result, deformation of and damage to the ring can be suppressed. Damage to the storage portion can be suppressed.

In the compressor according to one aspect of the present disclosure, the storage portion is provided in front of the midpoint (C) in the circumferential direction of a region other than the load region in the orbiting direction of the orbiting scroll.

The lubricant stored in the storage portion is guided to the load region in accordance with orbiting of the orbiting scroll. In the above configuration, the storage portion is provided in front of the midpoint in the circumferential direction of the region other than the load region in the orbiting direction of the orbiting scroll. As a result, a distance through which the lubricant travels is shorter than in a case where the storage portion is provided behind the midpoint in the orbiting direction. Therefore, the lubricant can be suitably guided to the load region. Therefore, in the load region, the impact when the recessed portion and the ring come into contact with each other can be suitably reduced. Therefore, noise caused by contact between the recessed portion and the ring can be suppressed.

REFERENCE SIGNS LIST

1: Electric compressor (compressor)
2: Housing (casing)
3: First housing
4: Second housing
5: Fixed scroll
6: Orbiting scroll
6*a*: End plate
6*b*: Back surface
7: Scroll compression mechanism
8: Discharge port
10: Discharge chamber
12: Thrust bearing
14: Compression chamber
15: Stator
16: Rotor
17: Motor
18: Drive shaft
19: Crank pin
20: Bearing
21: Bearing
24: Space
25: Inverter accommodating portion
30: Rotation prevention mechanism
31: Pin ring structure (rotation prevention structure)
32: Ring hole (recessed portion)
32*a*: Inner peripheral surface
33: Ring
33*a*: Inner peripheral surface
33*b*: Outer peripheral surface
34: Pin
41: Storage portion
42: Ring hole
42*a*: Inner peripheral surface
51: Storage portion
52: Ring hole
A1: Load region
A2: Counterload region
C: Midpoint
G: Gap

The invention claimed is:

1. A compressor comprising:

a casing that forms an outer shell, the casing having a suction port;

a low-pressure refrigerant gas from a refrigerating cycle received by the casing through the suction port;

a fixed scroll that is accommodated in the casing and fixed to a casing side;

an orbiting scroll that is meshed with the fixed scroll and orbits with respect to the fixed scroll;

a rotation prevention mechanism that prevents rotation of the orbiting scroll; and a lubricant supply device that supplies a lubricant to the rotation prevention mechanism, wherein the rotation prevention mechanism includes a recessed portion formed on either an orbiting scroll side or the casing side, a ring disposed in the recessed portion and having an outer peripheral surface facing an inner peripheral surface of the recessed portion, and a pin provided on either the orbiting scroll side or the casing side and engaged with an inner peripheral surface of the ring, a gap is formed between the inner peripheral surface of the recessed portion and the outer peripheral surface of the ring, and in a state in which a part of the outer peripheral surface of the ring is in contact with the inner peripheral surface of the recessed portion, a longest portion of the gap has a length of 0.1 mm or more and 0.6 mm or less to reduce a noise generated by a contact between the recessed portion and the ring, and to allow the low pressure refrigerant gas flowing from the refrigerating cycle to be compressed.

2. The compressor according to claim 1, wherein an outer diameter of the ring is 13 mm or more and 15.5 mm or less.

3. The compressor according to claim 1, wherein the recessed portion is provided with a storage portion recessed outward in a radial direction on the inner peripheral surface that is a cylindrical surface.

4. The compressor according to claim 3, wherein the rotation prevention mechanism has a plurality of rotation prevention structures that are a combination of the recessed portion, the ring, and the pin, the plurality of rotation prevention structures are disposed to sequentially receive a load in accordance with an orbiting motion of the orbiting scroll, the inner peripheral surface of the recessed portion of each of the rotation prevention structures has a load region over a predetermined angle range in which the load is received from the pin in accordance with the orbiting motion of the orbiting scroll, and the storage portion is provided in a region other than the load region on the inner peripheral surface of the recessed portion.

5. The compressor according to claim 4, wherein the storage portion is provided in front of a midpoint in a circumferential direction of the region other than the load region in an orbiting direction of the orbiting scroll.

6. A compressor comprising:

a casing that forms an outer shell;

a fixed scroll that is accommodated in the casing and fixed to a casing side;

an orbiting scroll that is meshed with the fixed scroll and orbits with respect to the fixed scroll;

a rotation prevention mechanism that prevents rotation of the orbiting scroll; and a lubricant supply device that supplies a lubricant to the rotation prevention mechanism, wherein the rotation prevention mechanism includes a recessed portion formed on either an orbiting scroll side or the casing side, a ring disposed in the recessed portion and having an outer peripheral surface facing an inner peripheral surface of the recessed portion, and a pin provided on either the orbiting scroll side or the casing side and engaged with an inner peripheral surface of the ring, the recessed portion is provided with a storage portion recessed outward in a radial direction on the inner peripheral surface that is a cylindrical surface, the storage portion is formed only on a part in a circumferential direction of the inner peripheral surface of the recessed portion, and the storage portion is configured to store the lubricant.

7. The compressor according to claim 6, wherein the rotation prevention mechanism has a plurality of rotation prevention structures that are a combination of the recessed portion, the ring, and the pin, the plurality of rotation prevention structures are disposed to sequentially receive a load in accordance with an orbiting motion of the orbiting scroll, the inner peripheral surface of the recessed portion of each of the rotation prevention structures has a load region over a predetermined angle range in which the load is received from the pin in accordance with the orbiting motion of the orbiting scroll, and the storage portion is provided in a region other than the load region on the inner peripheral surface of the recessed portion.

8. The compressor according to claim 7, wherein the storage portion is provided in front of a midpoint in a circumferential direction of the region other than the load region in an orbiting direction of the orbiting scroll.

* * * * *